US008141851B2

(12) United States Patent
Manev et al.

(10) Patent No.: US 8,141,851 B2
(45) Date of Patent: Mar. 27, 2012

(54) PORTABLE VEHICLE LIFT

(76) Inventors: Boytcho Manev, Goleta, CA (US); Eric B. Manev, Lake Worth, FL (US)

( * ) Notice: Subject to any disclaimer, the term of this patent is extended or adjusted under 35 U.S.C. 154(b) by 804 days.

(21) Appl. No.: 12/133,090

(22) Filed: Jun. 4, 2008

(65) Prior Publication Data

US 2008/0296542 A1 Dec. 4, 2008

Related U.S. Application Data

(60) Provisional application No. 60/941,837, filed on Jun. 4, 2007.

(51) Int. Cl.
*B66F 3/00* (2006.01)

(52) U.S. Cl. ..... 254/124; 254/126

(58) Field of Classification Search ..... 254/124.126
See application file for complete search history.

(56) References Cited

U.S. PATENT DOCUMENTS

| | | | | |
|---|---|---|---|---|
| 2,958,395 | A * | 11/1960 | Wallace | 187/219 |
| 3,565,396 | A | 2/1971 | Spear | |
| 3,826,470 | A | 7/1974 | Spear | |
| 3,891,108 | A | 6/1975 | Traficant | |
| 4,103,869 | A | 8/1978 | Mesny et al. | |
| 4,899,987 | A | 2/1990 | Craig | |
| 5,004,075 | A * | 4/1991 | Ascenzo | 187/210 |
| 5,275,378 | A | 1/1994 | Alten et al. | |
| 5,348,330 | A * | 9/1994 | Few et al. | 280/475 |
| 5,967,494 | A | 10/1999 | Fiorese et al. | |
| 6,059,263 | A * | 5/2000 | Otema et al. | 254/89 H |
| 6,182,796 | B1 * | 2/2001 | Perlstein et al. | 187/208 |
| 6,405,997 | B1 | 6/2002 | Granata et al. | |

* cited by examiner

*Primary Examiner* — Joseph J Hail
*Assistant Examiner* — Shantese McDonald

(57) ABSTRACT

A portable lift including a pair of elongate rails adapted for being located underneath corresponding lift points associated with a vehicle to be elevated. A pair of cross members fixedly securing at opposite ends to spaced apart locations associated with the rails and in order to construct a frame. Scissor jacks are associated with end location of the first and second rails. A drive shaft communicates to one or more of the scissor jacks, and responsive to a converted rotary input, actuates the jacks, separately or in unison, thereby causing the rails to vertically displaced for elevating and/or lowering the vehicle.

14 Claims, 9 Drawing Sheets

PORTABLE VEHICLE LIFT

CROSS REFERENCE TO RELATED APPLICATIONS

The present application claims the priority of U.S. Provisional Patent Application Ser. No. 60/941,837, filed Jun. 4, 2007, and entitled PORTABLE AND LOW PROFILE LIFT WITH WIDTHWISE EXTENDING SUPPORT RAILS POSITIONABLE UNDERNEATH A VEHICLE AND INCLUDING PAIRS OF SCISSOR JACKS ASSOCIATED WITH EACH RAIL RESPONSIVE TO A ROTARY INPUT TO AN ASSOCIATED DRIVE SHAFT COMMUNICATING WITH EACH PAIR OF SCISSOR JACKS FOR TRANSLATING THE SAME AND SELECTIVELY RAISING OR LOWERING THE RAILS AND ASSOCIATED VEHICLE.

FIELD OF THE INVENTION

The present invention refers generally to a portable floor jack and floor lift assemblies. More specifically, the present invention discloses a portable and low profile lift, capable of being powered by an electric hand drill, and which easily raise or lower a vehicle weighing 4,000 lbs or greater. More specifically, the present inventions disclose an improved portable, lightweight, and transportable lift constructed four individual and easily assembleable sections.

DESCRIPTION OF THE PRIOR ART

Vehicle lift assemblies are known in the prior art. The objective of such assemblies is the ability to be positioned underneath a vehicle and to quickly, safer and effectively raise and lower the vehicle in order to gain access underneath.

Known low rise lifts are constructed typically with a pair of parallel free deck rails (ramps) connected to legs. The decks are either individual or connected to each other via cross members(s). The legs are commonly fastened (bolted) to the floor for stability and safety. Legs are commonly pivoting. The pivoting legs will lift the ramps in an arc like movement, i.e. vertically as well as horizontally. This requires larger clearing space to accommodate the horizontal movement. In addition the lift can pose danger to a personnel or equipment in the horizontal area in which the lift moves.

Such prior lifts are also constructed to be floor mounted and of a standard size (width and length) accommodating most or all vehicles. As such, using them on smaller vehicles, such as further which may be located in confined spaces such as a single or double sized residential car garage, results in them taking up and excessive, and likely impracticable, amount of space, typically much larger than the vehicle foot print, this further making working in confined (limited) area unsafe and difficult.

SUMMARY OF THE PRESENT INVENTION

The present invention discloses an apparatus developed for home garages where safety, comfort, space, storage and weight are an issue. The vehicle lift is free standing and portable, allowing for wide range of applicable use, including home garages as well as race track, driveway, or upon other level surface. The lift is easily transportable and easily storable in either an assembled or disassembled configuration.

The portable lift includes a pair of first and second elongate extending rails adapted for being located underneath corresponding lift points associated with a vehicle to be elevated.

First and second pairs of scissor jacks each secure at upper end locations to an edge location of each rail. Each of the jacks exhibit a substantially "Y" shape in construction and include an arm pivotally connected to a midpoint of an angular extending support leg, the leg and arm also pivotally connecting at upper end locations associated with an underside location of the rail.

A pair of cross members are fixedly securing at opposite ends to spaced apart locations associated with the rails and in order to construct a frame. The cross members are further interchangeable to the appropriate vehicle size (i.e., width) the sizing the lift according to a specified vehicle size, thereby avoiding taking unnecessary floor space.

At least one drive shaft communicates with the scissor jacks and, in response to a rotary input, selectively actuates the jacks in unison, causing inner rail supported ends of the jacks, these being slidably disposed within a caged track associated with the supporting rail) to linearly translate in end-extending directions, this in turn causing the legs to pivot relative to the arms and to exhibit an increased vertical component for both elevating and lowering the vehicle. In one embodiment, one of the cross members incorporates a transfer drive shaft, and which can incorporate a desired linkage interconnecting either individual pairs, or both pairs (all four corner located scissor jacks) in synchronized fashion, thus allowing transfer of the driving motion to a second section assuring synchronized lifting of device and vehicle.

The caged tracks act as travel tracks for low friction guide blocks and bearings, and so that the legs are capable of being pulled (as defined by its pivotal translation along the rotating/threaded rods) in the outward (end) directions from the middle of the ramp via the opposite running threaded shaft. The lower portion of each leg contacts the ground surface approximate to an outermost extending end of the ramp and, in this fashion, provides an exceptional degree of stability to the lift.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
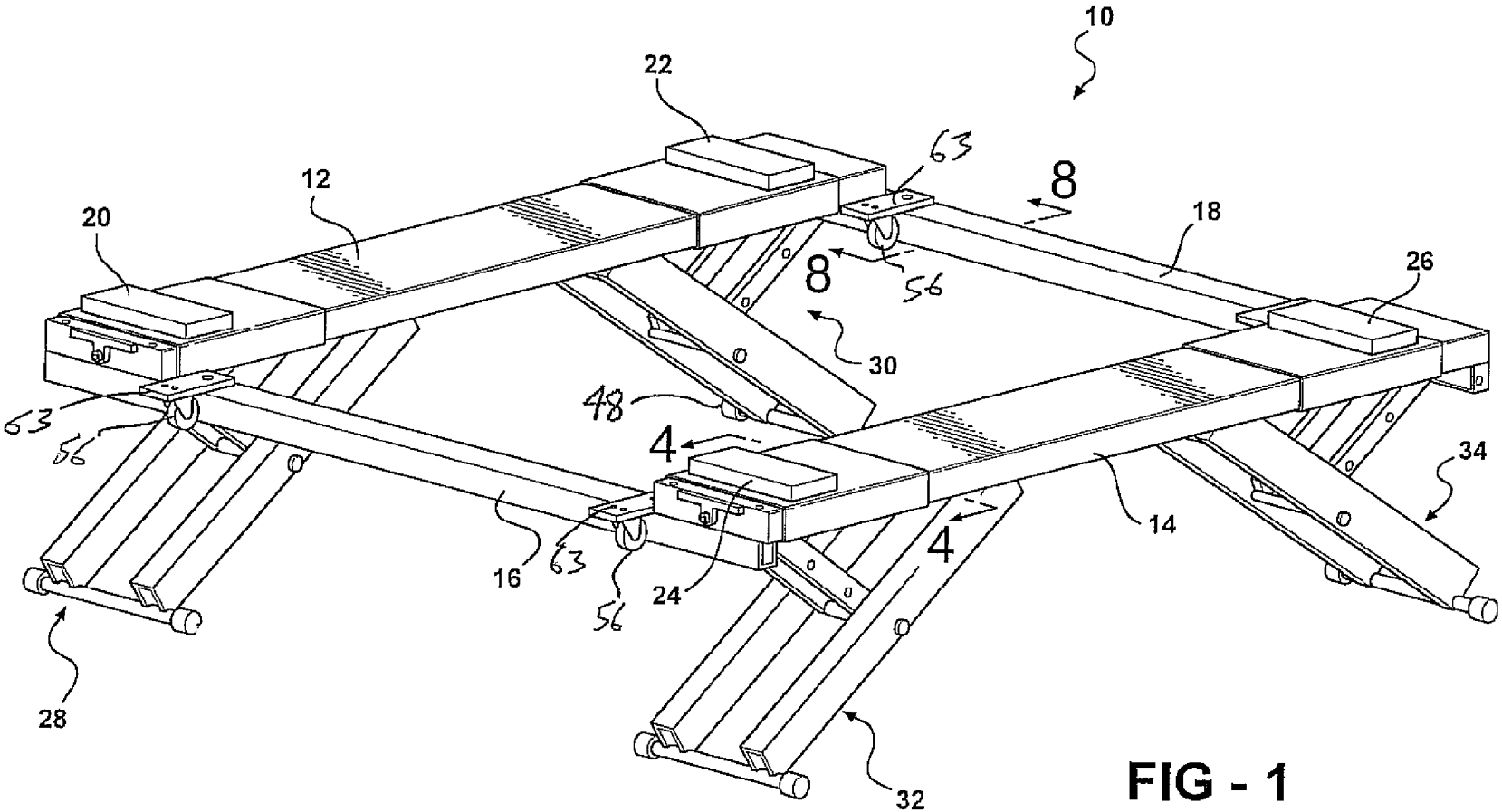
FIG. 1 is a perspective view of the vehicle lift according to the present invention.

Referring to FIG. 1, a portable and low profile lift is illustrated at 10, and which is capable of being powered by a rotary imparted force, such as a manual or powered drive unit (e.g. an electric hand drill) for easily raising or lowering a vehicle. More specifically, the present inventions disclose an improved portable, lightweight, and transportable lift constructed of four individual and easily assembleable sections, such as of a durable and lightweight rugged tubular (steel material) construction, and which establishes a number of secure lift point locations with the vehicle.

In relevant part, a pair of lifting rails 12 and 14 and associated and interconnecting cross members 16 and 18 are assembled by a socket wrench and bolts (not shown) into a generally rectangular frame shape. As will be further described, the cross members 16 and 18 can be sized (or substituted) to assemble a frame structure of a given width and which can more closely correspond to a desired vehicle. The cross members are further interchangeable to the appropriate vehicle size (i.e., width) the sizing the lift according to a specified vehicle size, thereby avoiding taking unnecessary floor space and while retaining the ability of the lift to not exceed the dimensional requirements associated with lifting and suspending a given vehicle type (e.g. staying within the footprint of the vehicle).

Figure 11:
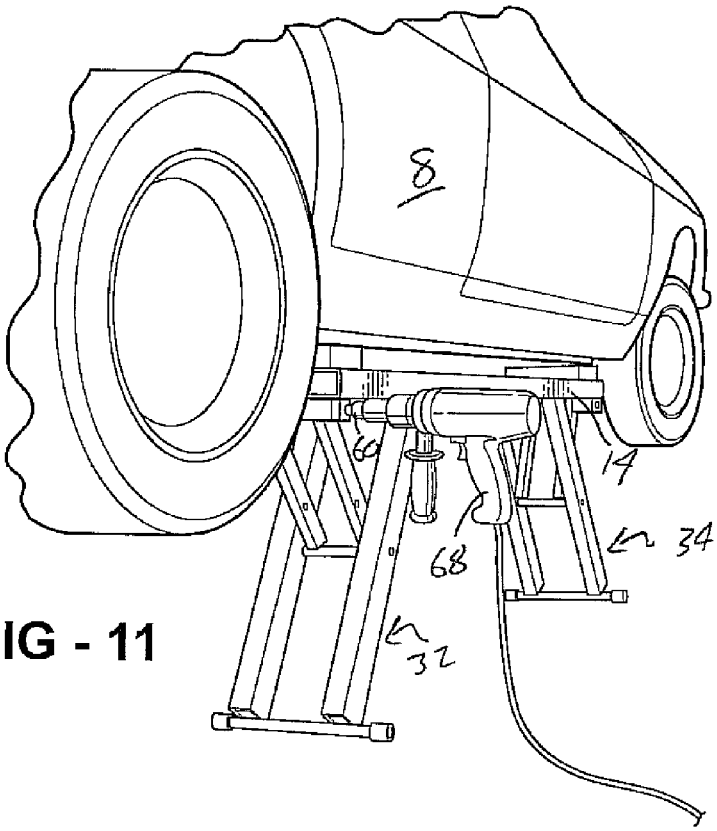
FIG. 11 is an environmental view showing a hand held drill motor engaging a selected drive shaft input associated with the lift and for elevating a supported vehicle.
Figure 15:
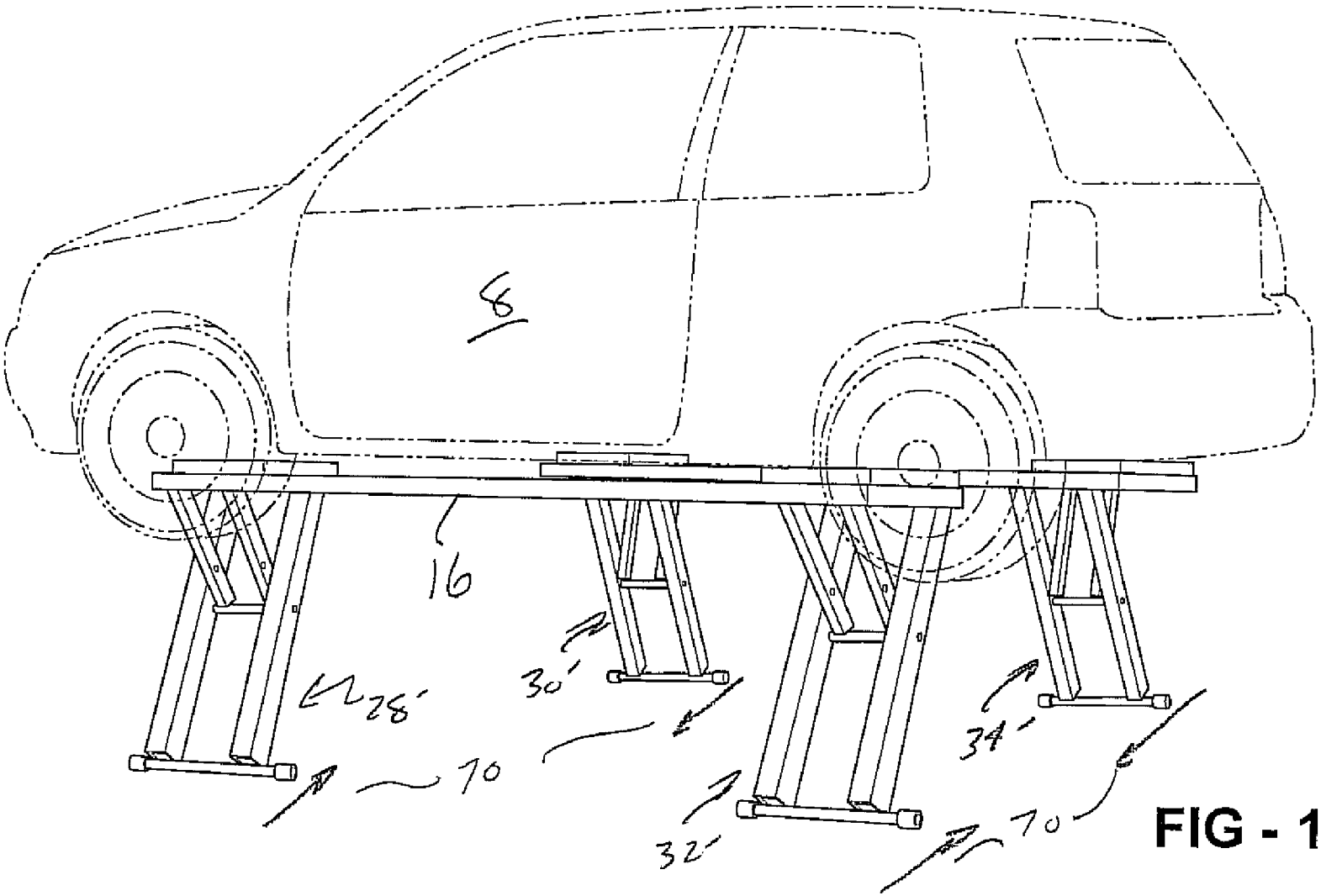
FIG. 15 is an alternate lift configuration to that shown in FIG. 11 and by which the lift assembly is repositioned so that the support rails extend widthwise, as opposed to lengthwise, relative to the vehicle and further that the jack legs displace inwardly in a perpendicular fashion relative to the longitudinal extending direction of the rails.

The rails 12 and 14 each include rubberized support pads, see at 20 & 22 for rail 12 and at 24 & 26 for rail 14, these being linearly traversable along the selected rail (see as shown for rail 14 in FIG. 9) and, upon being located, engage underside lift points associated with a vehicle (see for example alternate lifting configurations shown in FIG. 11 and further in FIG. 15).

Figure 2:
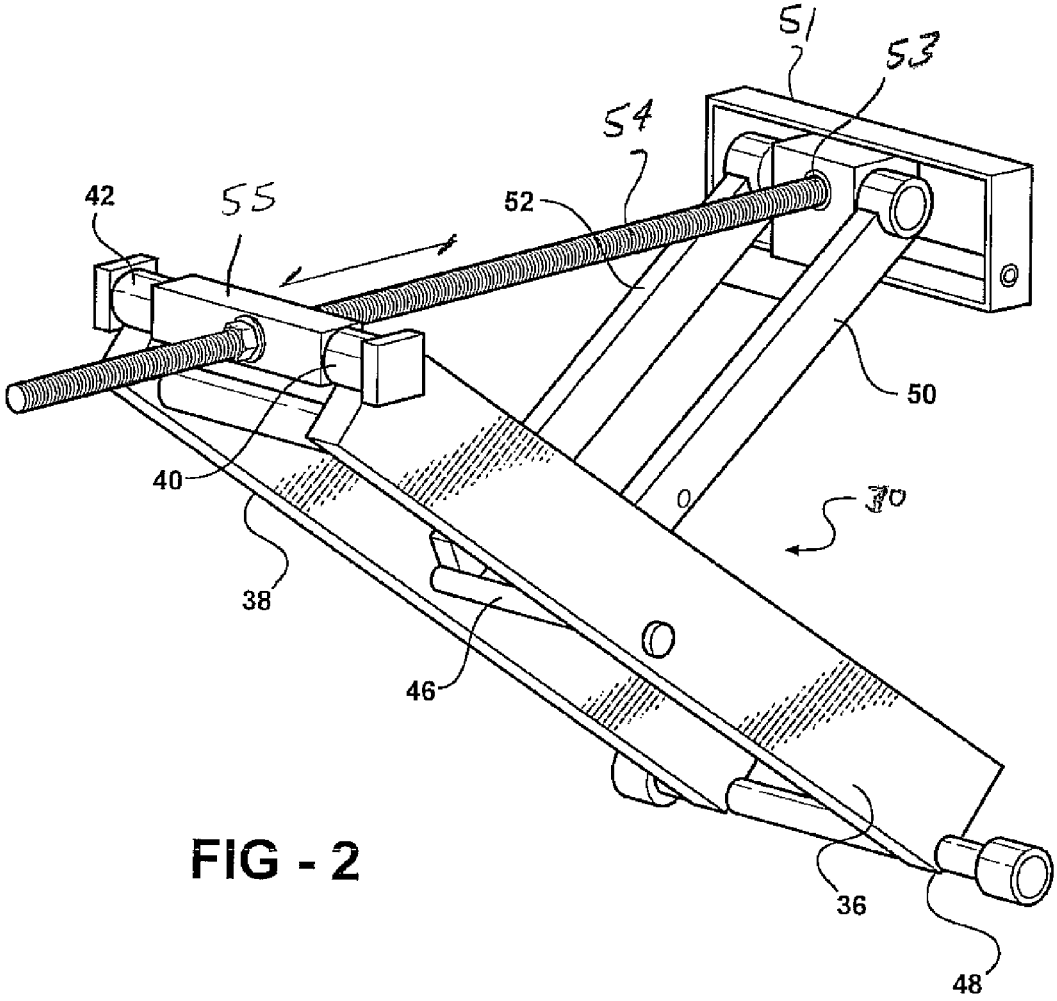
FIG. 2 is a sectional view illustrating a selected and substantially "Y" shaped scissor jack with pivotally associated and interconnected leg and arm sections, the leg being displaced upon rotation of the associated drive shaft raise and lower the selected rail.
Figure 3:
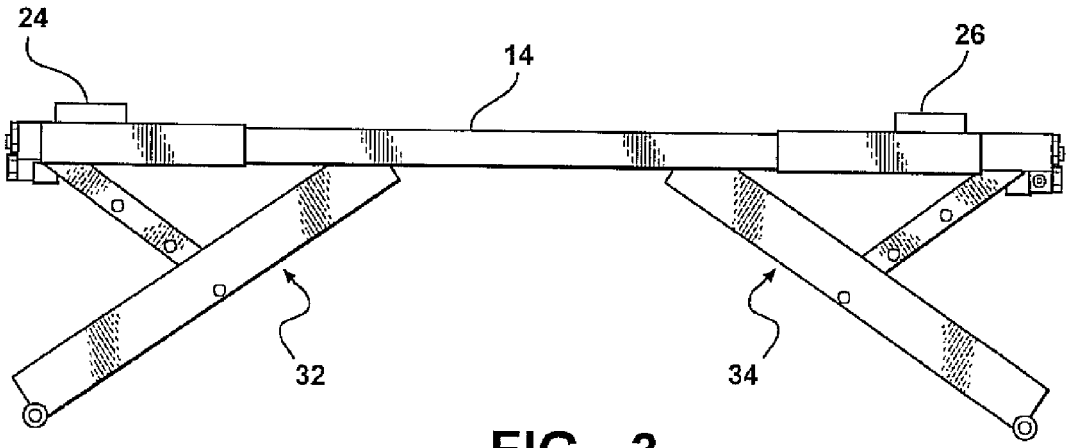
FIG. 3 is a plan view of the vehicle lift of FIG. 1 in a substantially elevated location.

As shown in FIG. 2, a sectional view illustrates a selected and substantially "Y" shaped scissor jack sub-assembly, of which four such scissor jacks are provided in pairs for each of the rails 12 and 14, and as shown at 28 & 30 for rail 12, as well as at 32 & 34 for rail 14. Each of the scissor jacks, referencing for example jack 30 in FIGS. 1, 2, and 7, includes a leg (see corresponding pair of spaced apart members 36 and 38 in FIG. 2) which are connected, at upper end locations 40 and 42 in slidable fashion to an underside track 44 (see FIG. 4) associated with selected rail 12. An intermediate crosswise support 46 extends between the spaced apart members 36 and 38, as does a lower most and translating roller stem 48.

A pair of arms 50 and 52 are fixedly secured at upper locations to substantial extending ends of the rails 12 and 14 (see rectangular shaped end support bracket 51 which is shown in FIG. 2 and which is hidden in an end-most mounting location associated with the underside of the rail 12 illustrated in FIG. 1). Lower ends of the arms 50 and 52 are pivotally associated with the leg sections 36 and 38 (see as fixed to intermediate support 46).

Figure 7:
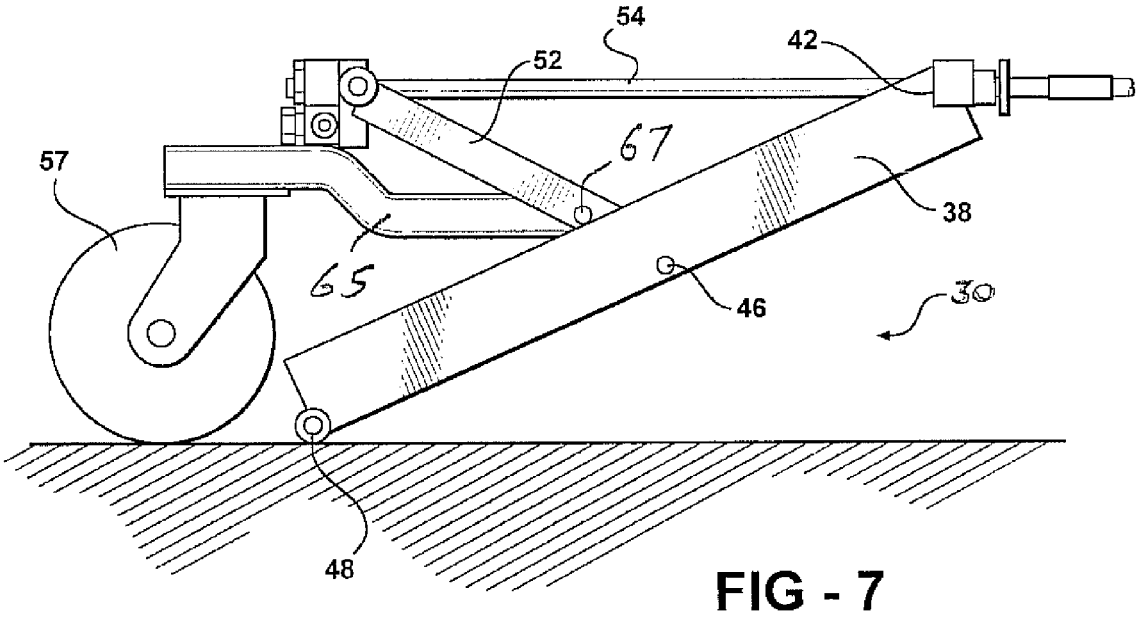
FIG. 7 is a sectional view of selected scissor jack in an intermediate elevating configuration and further showing the articulating relationship between the leg, arm and exteriorly threaded and rotatable drive shaft; showing also the optional moving casters

The leg members 36 and 38 are caused to be displaced upon rotation of an associated and exteriorly threaded drive shaft, see at 54 in each of FIGS. 2 and FIG. 7, and which secures at a first rotatably supported end 53 to a location associated with the end support bracket 51). A cross member 55 extends between the upper end locations 40 and 42 and receives, in threadably engaging fashion therethrough, the rotating drive shaft 54, the cross member 55 being supported or otherwise secured to the underside track 44 in a slidably displaceable relationship relative to the underside track 44. The underside caged tracks 44 act as travel tracks for low friction guide blocks and bearings, and so that the legs are capable of being pulled (as defined by its pivotal translation along the rotating/threaded rods) in the outward (end) directions from the middle of the ramp via the opposite running threaded shaft. The lower portion of each leg is positioned facing and outermost end of the ramp, at the location in which it contacts the ground. In this fashion, supporting each rail at its outermost (opposite) ends provides exceptional stability.

In this fashion, the rail underside supported and connecting ends 40 and 42 (associated with the legs) are caused to linearly translate in directions either towards or away from the corresponding outer rail ends (see again end support bracket 51 associated with jack 30). Such movement can initiate in either an up or down fashion, this in turn causing the lower roller stem 48 to translate along the ground (by virtue of the pivot force induced by the pivotally supported arms 50 and 52) to facilitate the concurrent and upward/downward displacement of the lift rails.

At least one drive shaft 54 extends lengthwise within and along the underside of the rails 12 and 14 and communicates with each pair (28 & 30 and 32 & 34) of the scissor jacks. In response to a rotary input, the driving action of the shafts 54 selectively actuate the pairs of jacks in unison, causing the inner rail supported ends of the jacks, such as at 55 in FIG. 2 and which is again slidably disposed within an associated caged track (at 44 in FIG. 4) associated with the supporting rail to linearly translate in end-extending directions. This in turn causes each of the associated scissor jack legs to pivot relative to their pivotally interconnecting arms providing an increased vertical component for both elevating and lowering the vehicle.

Alternative to the threaded drive shaft extending within the linear extending direction of each rail (or deck), it is also envisioned that the cross members 16 and 18 can also be designed to incorporate a threaded drive shaft, this further establishing a desired linkage (not shown) interconnecting either individual pairs of jacks. It is also envisioned that, between a pair of length or width wise extending and spaced apart threaded shafts, additional interconnecting linkages (also not shown) can be employed, these further extending within the frame constructed cross members or rail members depending upon the desired variant, and by which all four corner located scissor jacks are actuated in a synchronized fashion for lifting of the device and vehicle.

Figure 6:
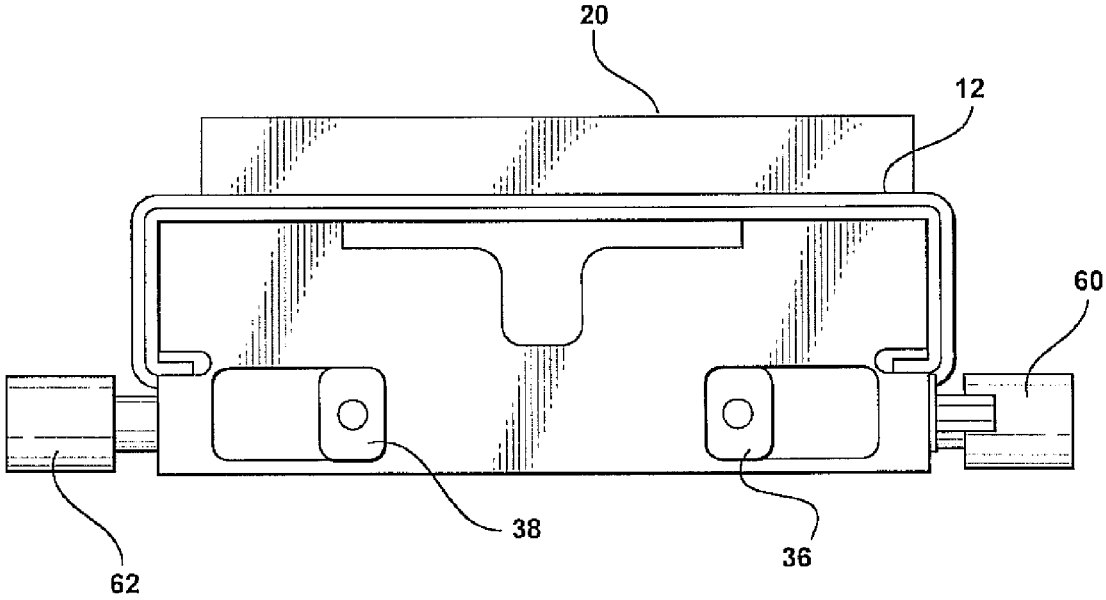
FIG. 6 is an end view in partial cutaway and illustrating the fully recessed nature of the support legs recessed within the selected rail.
Figure 10:
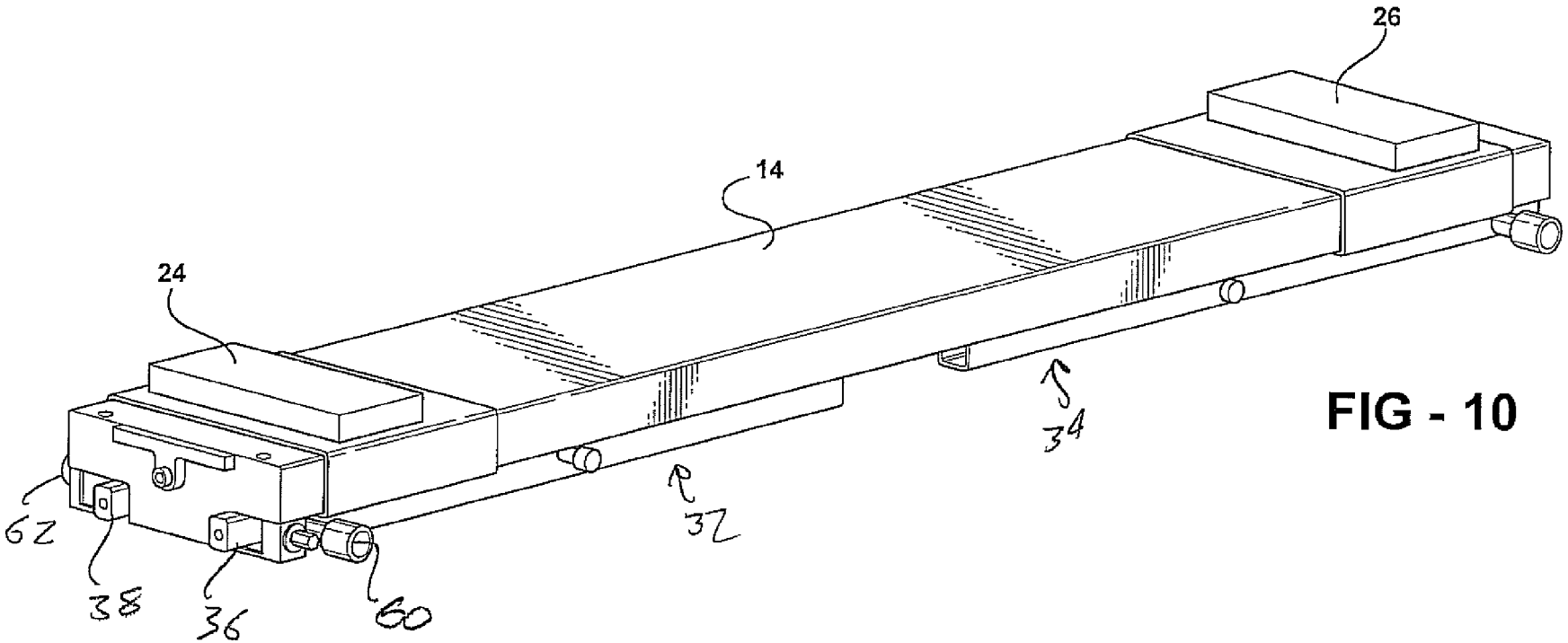
FIG. 10 is an assembled sectional view of a support rail illustrating both the features of first and second scissor jack legs in fully lowered/recessed fashion, as well as first and second corresponding input locations for receiving a hand held drill motor and, correspondingly, for actuating the threaded drive screws for actuating the scissor jacks in upwardly displacing fashion.

Upon engaging a rotary input force to rotate each of the threaded shafts 54, such as referenced at 60 and 62 in FIGS. 6 and 10 and which is meant to represent rotary driven component for transferring its rotating force to the shaft through an appropriate bevel or other suitable gearing, each shaft, or pair of such linearly extending drive shafts associated with the rails 12 and 14, are caused to rotate so that their respectively slaved pairs of scissor jacks to selectively raise and lower the rails, such as from a stowed position located at 4" from a ground surface up to a maximum elevation of 26", this permitting greater convenience and safety to a user when working underneath a vehicle.

As described above, a selected one (or both) of the cross bars 16 or 18 may further include a build in drive shaft (not shown), this allowing a transfer of drive motion to a second section (i.e. another exteriorly transfer drive shaft concurrently actuating the secondary pair of scissor jacks associated with the other rail) and thus assuring synchronized lifting of device and vehicle. Accordingly, and in one preferred variant, the lift legs are capable of being driven by common shaft for synchronized operation, and as opposed to lifting first and second pairs of scissor jacks individually in order to incrementally reposition the lift platform.

In one non-limiting variant, the rails 12 and 14 each are approximately 60" in length for greater stability and vehicle support. The scissor jacks 28 & 30 and 32 & 34 are again each of a substantially "Y" shaped single legged construction (see again FIG. 2), and with each leg incorporating an associated sliding assembly where the upper portion is sliding within the caged track (see again as referenced at 44 in FIG. 4) defined in an underneath location of the associated supporting deck.

Accordingly, the lower portion of each scissor jack leg extends to a ground contacting location most closely aligned with the outer end of the rail (see as best shown in FIG. 7). Supporting the rail at its most outward end accordingly provides the apparatus with an exceptional degree of firmness and robustness. The lifts legs, see again at 36 and 38, and associated arms 50 and 52 may further be constructed from hollow profiles for increased strength and reduced mass and whereby this type of scissor jack arrangement reduces weight, lowers cost and minimizes floor foot print (see again FIG. 1) and which further permits safe use of the lift assembly on both slanted and out of level flat areas. As further referenced in each of FIGS. 4 and 9, the caged tracks act as travel tracks for low friction guide blocks and bearings (see as generally represented at 59 and 61 in FIG. 4) and which permit the opposing pairs of scissor jacks 28 & 30 and 32 & 34 to safely elevate and lower the upper facing and supported rails 12 and 14.

Figure 5:
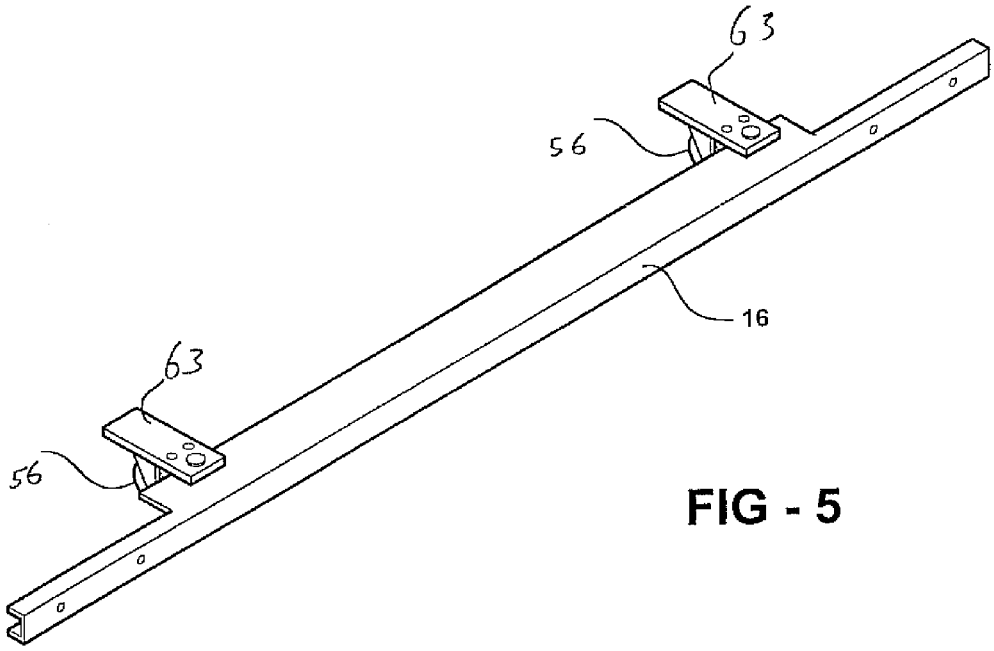
FIG. 5 is an illustration of a selected cross member forming a portion of the vehicle lift.

Referring to FIG. 5, an illustration is shown at 16 of a selected cross member forming a portion of the vehicle lift. As previously described, each of the cross bars (spacers) exhibit a low profile designed for easy attaching and detaching, making the unit compact for transportation and storage (see recessed storage configuration of FIG. 6). The cross members 16 and 18 may also be equipped with spring loaded casters (see as shown by example at 56 in FIG. 8) which are secured to the associated cross member 16 or 18 by an upper edge secured bracket or the like, see as further shown at 63. The casters (of which a total of four are provided, two at each of end of a selected cross member) are typically of the swivel type, thereby providing mobility to the lift assembly and allowing it to be rolled underneath a vehicle as a platform for use. As also previously described, additional pairs of cross members can be provided according to other dimensions and in order to construct a lift frame of varying width to accommodate both smaller application areas (e.g. residential garages) as well as small sized vehicles.

Figure 8:
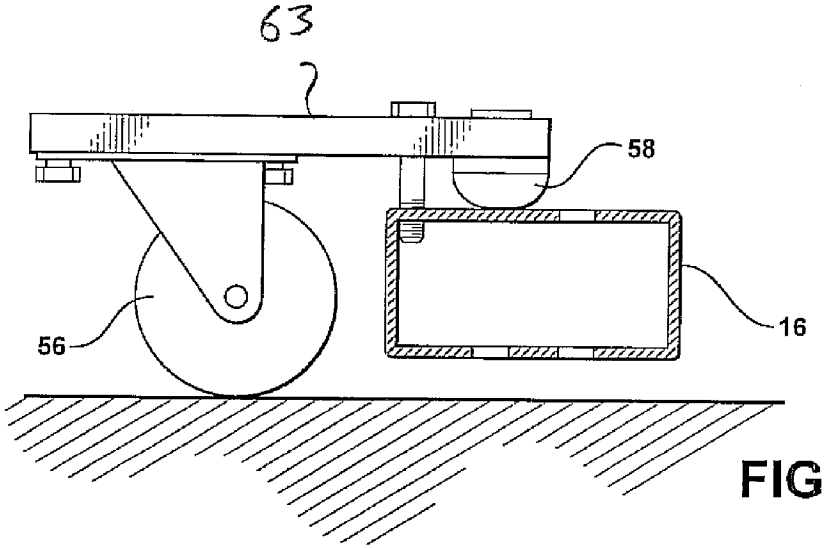
FIG. 8 is a cutaway view taken along line 8-8 of FIG. 1 and illustrating the spring loaded and swivel type casters associated with the ends of each cross member and for providing mobility to the lift upon the same being rolled underneath a vehicle.

In areas where space is limited, the low profile of the lift in its retracted condition permits for a vehicle to be driven over the low profile cross members (again FIG. 8). The spring loaded casters may further allow the cross members to be depressed against the floor surface, creating friction and preventing the lift from slipping and/or moving on the ground, and while be also including a rubber bumper spring or like component, at 58 in FIG. 8, for preventing the cross member from bending or buckling against its contact location associated with the castor 56 (again FIG. 8). In this manner, the forgiveness of the springs will protect the wheels from being damaged by the weight of the vehicle and while permitting a maximum of degree of adjustability relative to the vehicle.

It is further contemplated that the lift may provide for attaching additional casters, see at 57 in FIG. 7, allowing movement the vehicle when supported on the lift to other locations and/or storage (see FIG. 7). The casters 57 are each connected to a support bracket, see at 65 in FIG. 7, which is capable of being attached (via quick released pins or the like) to the legs 38 and arms 52 (again FIG. 7) and can be attached only when the vehicle is lifted off the ground (see also environmental view of FIG. 13).

In order to engage the castor wheels 57, each of the lift rails 12 and 14 are lowered to a point where each leg and caster mount will interlock. At this position, the vehicle wheels are still supported above the ground, and the lift sections (rails) are resting upon the mounted casters. The casters quick release pin, see as referenced at 67 in FIG. 7, when engaged, prevents the lifts legs from being raised more than ¾" off the ground, in order to provide for additional safety and stability. In the instance of the vehicle being raised and lowered during the servicing period, the casters are left attached and until the vehicle is ready to be lowered to the ground surface.

FIG. 6 illustrates an end view in partial cutaway of the fully recessed nature of the support legs 36 and 38 recessed within the selected rail 12. The rotary drill inputs (such as for receiving a ⅜" hand held drill motor and for in turn actuating the exteriorly threaded and rotatably slaved drive shafts, e.g. shown at 54, are further referenced at 60 and 62. Although not described in detail, it is understood that the appropriate linkages are provided to slave the rotary drill input to the pair of threaded and extending drive shafts (e.g. by example at 54 in the intermediate lifting configuration of FIG. 7) associated with the first and second pairs of scissor jacks (and which are again interconnected by a connecting shaft such as is built into a selected cross member for providing synchronized motion of the pairs of jacks in unison to raise and lower the rails 12 and 14.

Figure 4:
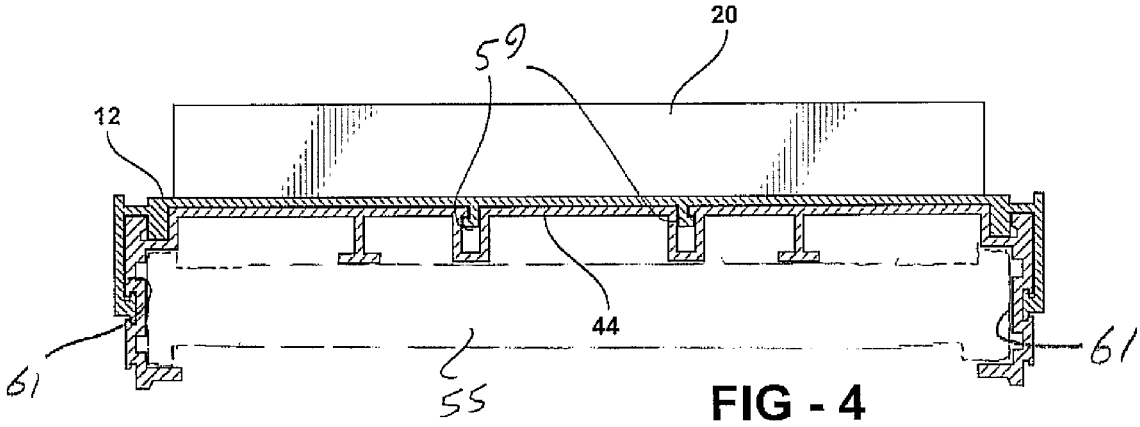
FIG. 4 is an end cutaway view, taken along line 4-4 in FIG. 1, and illustrating the manner in which the upper leg portion is slidably disposed within a caged guide rail/track.
Figure 9:
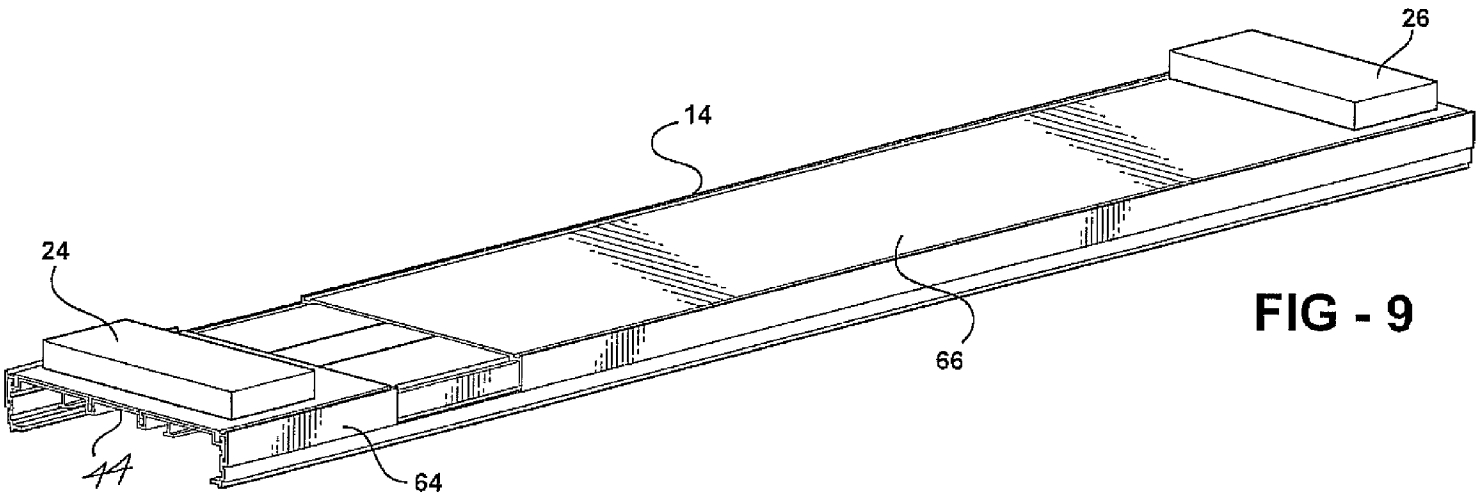
FIG. 9 is a sectional view in perspective of a selected rail, also shown in FIG. 4, and illustrating the telescopic nature of the sliding tray and upper mounted rubber pads for engaging selected vehicle lift points.

Referencing again FIG. 9, a sectional view is shown in perspective of a selected rail 14 according to a further modified variant, similar in respects to that also shown in FIG. 4, and further illustrating a telescopic sliding tray, see at 64 and 66, and associated upper mounted rubber pads, again at 24 and 26, for engaging selected vehicle lift points. The trays 64 and 66 are supported in linearly traversable fashion within caged guides, and which are independent from those of the legs. In this variant, the upwardly facing trays 64 and 66 slide within the perimeters of the lifts sections or rails 12 and 14, and between where the cross members 16 and 18 are attached. Upon detaching the cross members, the trays 64 and 66 can be extended beyond the perimeter of each rail section 12 and 14, this allowing the rails to be converted to independent vehicle loading ramps. In this application, the reconfigured rails along with the recessed lift legs (scissor jacks) serve to providing additional stability and ruggedness in its application as ramps.

Addressing further FIG. 10, an assembled sectional view of a support rail illustrates both the features of first and second scissor jack legs in fully lowered/recessed fashion, as well as first and second corresponding input locations for receiving a hand held drill motor and, correspondingly, for actuating the threaded drive screws for actuating the scissor jacks in upwardly displacing fashion.

Referring now to FIG. 11, an environmental view is shown of a hand held drill motor engaging a selected drive shaft input (e.g. as previously described at 62 in 10) associated with the lift and for elevating a supported vehicle. The vehicle to be lifted is generally shown at 8 and the drill at 68.

Figure 12:
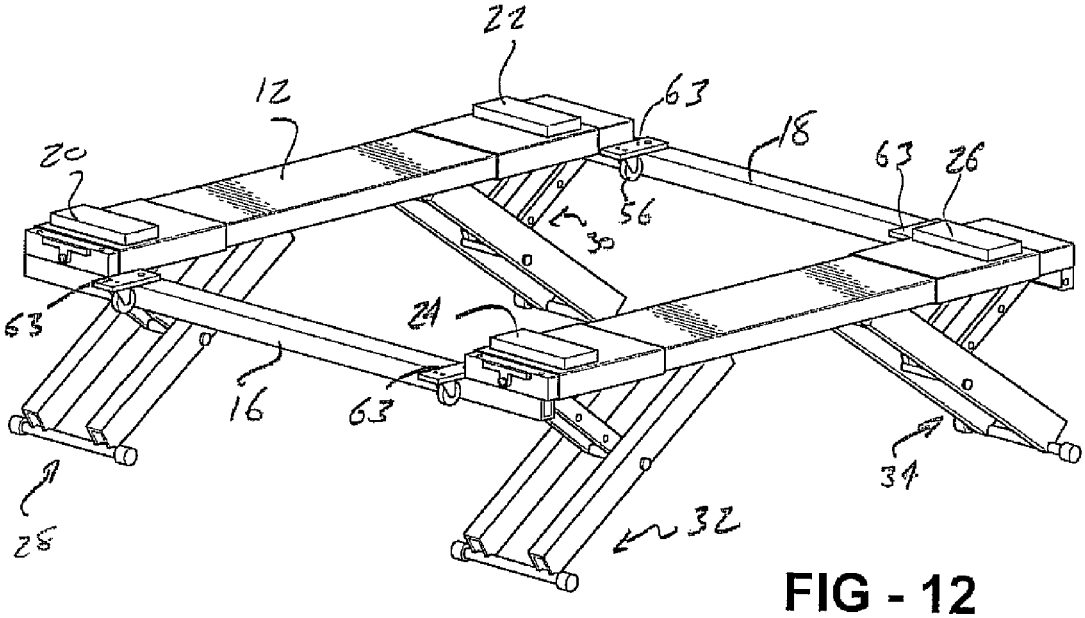
FIG. 12 is a rotated perspective illustration of the vehicle lift also shown in FIG. 1.
Figure 13:
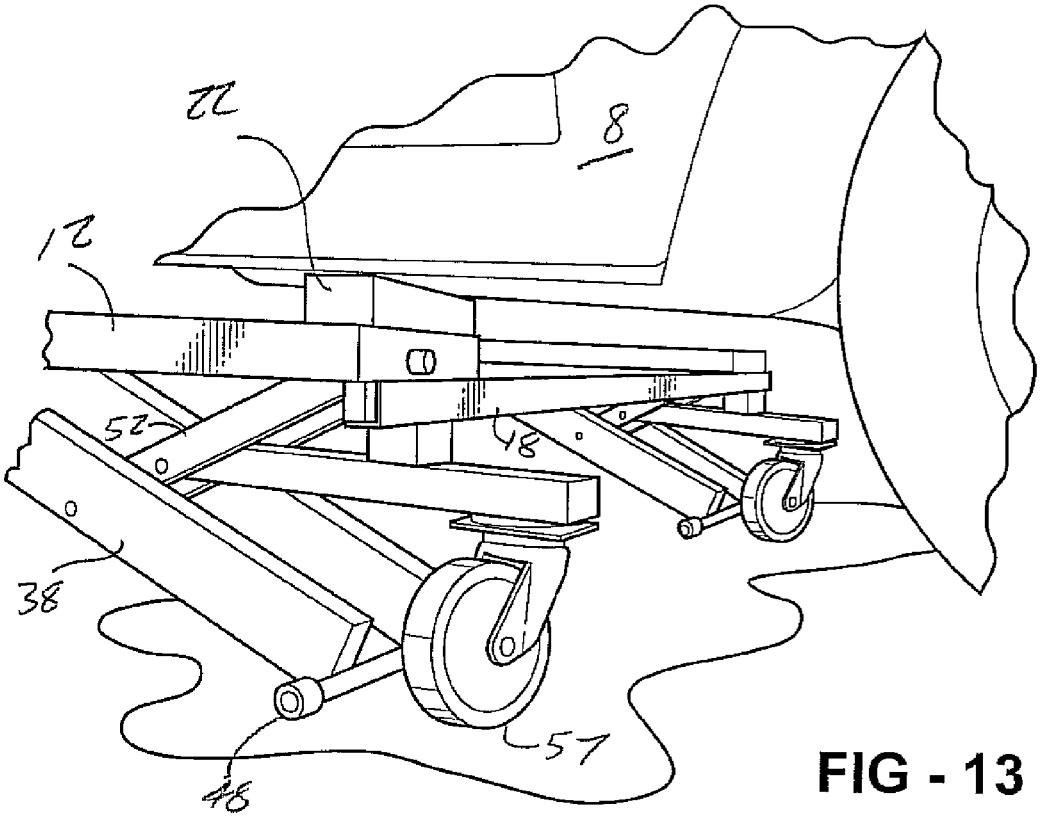
FIG. 13 is a rotated view of a selected scissor jack assembly, similar to that shown in FIG. 7, and illustrating a vehicle in an intermediate lifted condition.
Figure 14:
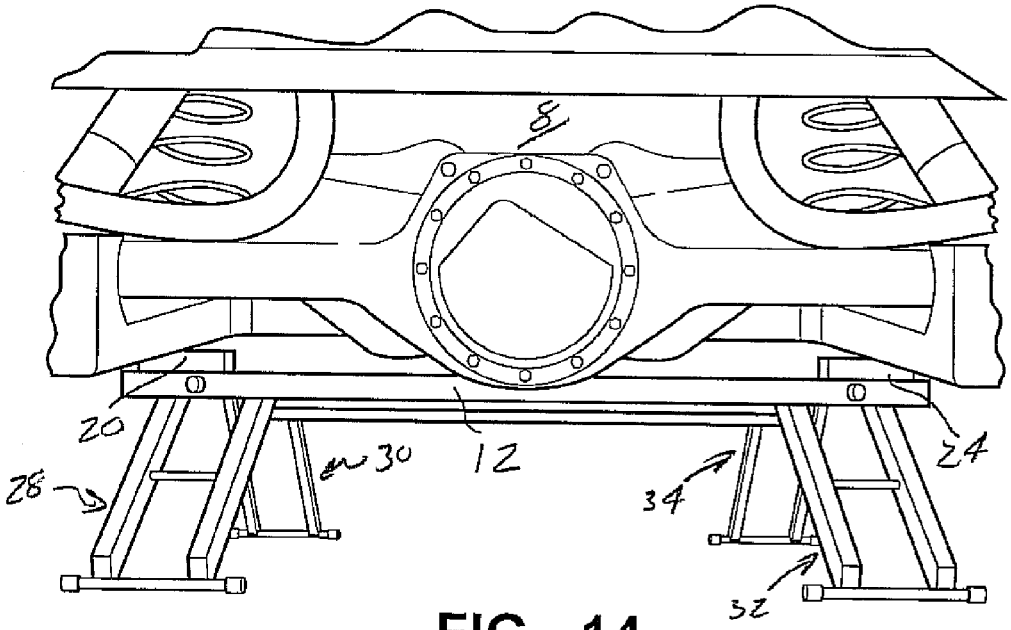
FIG. 14 is an end view of the lifting configuration shown in FIG. 11.

FIG. 12 is a rotated perspective illustration of the vehicle lift also shown in FIG. 1. FIG. 13 is a rotated view of a selected scissor jack assembly, similar to that shown in FIG. 7, and illustrating a vehicle in an intermediate lifted condition. FIG. 14 further shows an end view of the lifting configuration shown in FIG. 11.

Finally, FIG. 15 is an alternate lift configuration to that shown in FIG. 11 and in which the lift assembly is positioned so that the support rails extend widthwise relative to the vehicle 8. The lift mechanism shown in FIG. 15 is otherwise similar in design to that in FIG. 1, with the exception that the direction of inward/upward displacement of the legs, see at 28' & 30' and 32' & 34', is perpendicular to the longitudinal distance of the rails 12 and 14, and as opposed to parallel as shown in FIG. 1. As such, the inward displacing travel of the legs associated with each jack (see arrows 70 in FIG. 15) are crosswise as opposed to lengthwise as in FIG. 11.

An apparatus developed for home garages where space, storage and weight are an issue. This apparatus is a free standing design allowing to be used not only in home garages but also on the race track, drive ways or simply on the field. This lift is developed to be easily transportable and easily storable, and in either an assembled or disassembled configuration. Targeted users are the classic car home mechanics (restorer); weekend car racer and autocrossers; and mobile car repair services. This low profile low rise apparatus will lift a vehicle gradually from under 4" up to 26 inches off the ground.

According to additional preferred variants, four (4) sizes of cross spacers can be provided in increments of 14 inches. The lift can further accommodate cars with frames or unibody frames from 15 to 76 inches wide. Additional features also include optional 6" heavy duty moving casters, each consisting of four 6" non-marring polyurethane casters—two (2) with brakes and two (2) with 90 degree (quarter turn) lock. The quarter turn locks allow for safe, controlled movement of your vehicle while is on the lift which allow the vehicle to be moved around the garage work area while supported upon the lift, thus allowing for long term projects that keep the vehicle off the ground for an extended period of time. This can occur such as while waiting for parts to arrive or for time to do the work, and while allowing a user to move or reposition the vehicle while elevated in order to free up the space in the garage or when it is desired to move the project vehicle from its storage place to the work area.

The lifts legs are also constructed of hollow profile tubular metal, providing increased strength and reduced weight/mass. This type of scissor jack arrangement reduces weight, lowers cost and minimizes floor foot print. The lift sections with the ruggedly attached cross members collaborate in creating a large frame-like jack stand, each exhibiting a leg located at each corner, providing exceptional stability and ruggedness. This allows use of the apparatus on slightly slanted and out of level flat areas.

The lift is intended to be totally portable and can be handled by a single person. The lift mechanism is designed to be light weight, easy to assemble and disassemble, easy to transport and simple to store. The light weight legs can be completely recessed into the undersides of the rails (see again FIG. 10).

One set of legs can include the additional (small) rollers attached to allow wheeling (rolling) the sections, one or both at a time. The cross members are further designed with a low profile for easy attaching and detaching, to and from the rails, making the unit compact for transportation and storage. The lower profile castors associated with the cross members are also of the swivel type, giving mobility to the lift and allowing it to be rolled underneath a vehicle, similar to a common floor jack.

In areas where the space is limited, the vehicle could be driven over the low profile cross members. The spring loaded casters allow the cross members to be pressed to the floor surface, creating friction and preventing the lift from slipping and/or moving on the ground. The forgiveness of the springs will protect the wheels from being damaged by the weight of the vehicle. When the vehicle is in place the lift could be moved (placed, adjusted) to exact position for operation and use.

The compact design, the low profile cross members and the hollow profile legs incorporated in the ramps (section) qualify the lift as a low profile unit. In one variant, an overall height to the top of the rubber pads is less than 4" off the ground. Most common floor jacks are above 4" high (see FIG. 6).

Having described my invention, other and additional preferred embodiments will become apparent to those skilled in the art to which it pertains, and without deviating from the scope of the appended claims.

We claim:

1. A portable lift comprising:

a frame including a pair of rails and at least one interconnecting cross member;

each of said rails exhibiting an upper surface establishing vehicle lift points;

a plurality of jacks mounted to end locations of said rails;

said jacks each further comprising first and second pairs of scissor jacks, each securing at upper end locations to a linearly displaceable and underside accessible caged guide rail defined in an open underside end location of each rail and, upon actuating, permitting angled legs associated with each of said jacks to displace concurrent with elevating said rails;

inner rail supported ends of said jacks, these being slidably disposed within a caged track associated with the supporting rail to linearly translate in end-extending directions, this in turn causing the legs to pivot relative to the arms and to exhibit an increased vertical component for both elevating and lowering the vehicle;

at least one synchronizing shaft interconnecting first and second drive shafts associated with said first and second rails for actuation said first and second pairs of scissor jacks; and at least one drive shaft communicating with said jacks and, responsive to a rotary input, for selectively actuating at least one of said jacks to cause said rails to vertically displace.

2. The lift as described in claim 1, each of said rails having a specified shape and size and further comprising a pair of upwardly facing and rubberized pad supports.

3. The lift as described in claim 2, further comprising each of said pad supports mounted upon sliding trays adapted to being linearly repositioned along said rails for accommodating vehicle lift points.

4. The lift as described in claim 1, further comprising a plurality of spring loaded and swivelable castors fixedly mounted to locations associated with said cross members and, upon fully retracting said legs associated with said rails, permitting said lift to be traversed to or under a vehicle.

5. The lift as described in claim 4, further comprising a second plurality of castors capable of being attached via quick released pins to said jack legs when the vehicle is lifted off the ground, a quick release pin, when engaged, prevents lifting of said legs more than ¾" off the ground in order to provide for additional safety and stability.

6. The lift as described in claim 1, each of said scissor jacks further comprising:

a substantially "Y" shaped sub-assembly in which each leg further comprising a pair of spaced apart members connected, at upper end locations and in slidable fashion to said underside guide rail;

an intermediate crosswise support extending between said spaced apart members;

a lower most and translating roller stem extending between lowermost locations associated with said legs and traversable along a ground surface upon actuating of said jack; and a pair of arms fixedly secured at upper locations to ends of said rails, whereas lower ends are pivotally associated with said leg sections via said intermediate crosswise support;

upon said spaced apart legs being displaced upon rotation of said associated and exteriorly threaded drive shaft, said rail connecting ends of said legs are caused to linearly translate in directions towards said outer rail ends (up), as well as away and towards the center of the rail (down), this in turn causing said lower roller stem to translate along the ground to facilitate the concurrent and upward and downward displacement of the lift.

7. The lift as described in claim 6, further comprising at least one drive shaft communicating with said scissor jacks and, in response to a rotary input, selectively actuating the jacks in unison in either one of an elevating or lowering fashion.

8. The lift as described in claim 1, further comprising said legs pivotally displacing upon rotation of an associated and exteriorly threaded drive shaft which secures at a first rotatably supported end to a location associated with an end support bracket secured to said rail underside, a cross member extending between upper end locations of said legs and receiving, in threadably engaging fashion therethrough, said rotating drive shaft, said cross member being supported or otherwise secured to said underside track in a slidably displaceable fashion.

9. A portable lift comprising:

a pair of first and second elongate extending rails adapted for being located underneath corresponding lift points associated with a vehicle to be elevated;

a pair of cross members fixedly securing at opposite ends to spaced apart locations associated with said rails and in order to construct a frame;

a plurality of scissor jack associated with end locations of said first and second rails; and at least one drive shaft communicating with said scissor jacks and responsive to a rotary input for selectively actuating said jacks in unison and causing said rails to contact and to elevate or lower the vehicle;

first and second pairs of scissor jacks, each securing at upper end locations to a linearly displaceable caged guide rail defined in an open underside end location of each rail and, upon actuating, permitting angled legs associated with each of said jacks to displace outwardly concurrent with elevating said rails; and a synchronizing shaft interconnecting first and second drive shafts associated with said first and second rails for actuation in turn said first and second pairs of scissor jacks.

10. The lift as described in claim 9, each of said rails having a specified shape and size and further comprising a pair of upwardly facing and rubberized pad supports in turn mounted upon associated sliding trays for linear positioning relative to the vehicle lift points.

11. The lift as described in claim 9, further comprising a plurality of spring loaded and swivelable castors fixedly mounted to locations associated with said cross members and, upon fully retracting said legs associated with said rails, permitting said lift to be traversed to or under a vehicle.

12. The lift as described in claim 11, further comprising a second plurality of castors capable of being attached via quick released pins to said jack legs when the vehicle is lifted off the ground, a quick release pin, when engaged, prevents lifting of said legs more than ¾" off the ground in order to provide for additional safety and stability.

13. The lift as described in claim 9, each of said scissor jacks further comprising:

a substantially "Y" shaped sub-assembly in which each leg further comprising a pair of spaced apart members connected, at upper end locations and in slidable fashion to said underside guide rail;

an intermediate crosswise support extending between said spaced apart members;

a lower most and translating roller stem extending between lowermost locations associated with said legs and traversable along a ground surface upon actuating of said jack; and a pair of arms fixedly secured at upper locations to ends of said rails, whereas lower ends are pivotally associated with said leg sections via said intermediate crosswise support;

upon said spaced apart leg portions being displaced upon rotation of said associated and exteriorly threaded drive shaft, said rail connecting ends of said legs are caused to linearly translate in directions towards said outer rail ends (up), as well as away and towards the center of the rail (down), this in turn causing said lower roller stem to translate along the ground to facilitate the concurrent and upward and downward displacement of the lift.

14. A portable lift comprising:

a frame including a pair of rails and at least one interconnecting cross member;

each of said rails exhibiting an upper surface establishing vehicle lift points;

a plurality of jacks mounted to end locations of said rails;

said jacks each further comprising first and second pairs of scissor jacks, each securing at upper end locations to a linearly displaceable and underside accessible caged guide rail defined in an open underside end location of each rail and, upon actuating, permitting angled legs associated with each of said jacks to displace concurrent with elevating said rails;

a plurality of spring loaded and swivelable castors fixedly mounted to locations associated with said cross members and, upon fully retracting said legs associated with said rails, permitting said lift to be traversed to or under a vehicle;

a second plurality of castors capable of being attached via quick release pins to said jack legs when the vehicle is lifted off the ground, a quick release pin, when engaged, preventing lifting of said legs more than ¾" off the ground in order to provide for additional safety and stability; and at least one drive shaft communicating with said jacks and, responsive to a rotary input, for selectively actuating at least one of said jacks to cause said rails to vertically displace.

* * * * *